US009975327B1

(12) United States Patent
Yang et al.

(10) Patent No.: US 9,975,327 B1
(45) Date of Patent: May 22, 2018

(54) SYSTEM AND METHOD FOR ADJUSTING PRINTHEAD OPERATIONS IN A DIRECT-TO-OBJECT PRINTER HAVING A FIXED PRINTHEAD ARRAY

(71) Applicant: Xerox Corporation, Norwalk, CT (US)

(72) Inventors: Xin Yang, Webster, NY (US); Paul J. McConville, Webster, NY (US); Christine A. Steurrys, Williamson, NY (US); David R. Stookey, Walworth, NY (US); Martin L. Frachioni, Rochester, NY (US); Dale R. Breed, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days. days.

(21) Appl. No.: 15/598,807

(22) Filed: May 18, 2017

(51) Int. Cl.

| | |
|---|---|
| ***B41J 2/045*** | (2006.01) |
| ***B41J 3/407*** | (2006.01) |
| ***B41J 11/00*** | (2006.01) |
| ***B41J 3/50*** | (2006.01) |
| ***B41J 2/21*** | (2006.01) |
| ***B41J 3/54*** | (2006.01) |

(52) U.S. Cl.
CPC ..... *B41J 2/04508* (2013.01); *B41J 2/04586* (2013.01); *B41J 2/21* (2013.01); *B41J 3/4073* (2013.01); *B41J 3/4078* (2013.01); *B41J 3/50* (2013.01); *B41J 3/543* (2013.01); *B41J 11/002* (2013.01)

(58) Field of Classification Search
CPC ..... B41J 2/01; B41J 2/04508; B41J 2/04586; B41J 2/21; B41J 3/4073; B41J 3/4078; B41J 3/50; B41J 3/543; B41J 11/002
See application file for complete search history.

(56) References Cited

U.S. PATENT DOCUMENTS

| | | | | |
|---|---|---|---|---|
| 6,135,654 | A | 10/2000 | Jennel | |
| 6,360,656 | B2 | 3/2002 | Kubo et al. | |
| 6,923,115 | B1 | 8/2005 | Litscher et al. | |
| 7,736,713 | B2 | 6/2010 | Uptergrove | |
| 7,740,349 | B2 * | 6/2010 | Tezuka | B33Y 30/00 347/101 |
| 8,372,726 | B2 | 2/2013 | de Graff et al. | |
| 8,666,142 | B2 * | 3/2014 | Shkolnik | G06T 1/00 382/154 |
| 9,302,506 | B2 | 4/2016 | Uptergrove et al. | |
| 9,333,741 | B2 | 5/2016 | Nick et al. | |
| 9,632,037 | B2 * | 4/2017 | Chen | G01N 21/8851 |
| 2009/0169719 | A1 | 7/2009 | Orr | |
| 2017/0046548 | A1 | 2/2017 | Kamijo et al. | |

FOREIGN PATENT DOCUMENTS

| | | | |
|---|---|---|---|
| EP | 2 591 917 | A1 | 5/2013 |
| WO | 2004/016438 | A1 | 2/2004 |

* cited by examiner

*Primary Examiner* — Anh T. N. Vo

(74) *Attorney, Agent, or Firm* — Maginot Moore & Beck LLP

(57) ABSTRACT

A direct-to-object printer includes a plurality of imaging devices that generates image data of an object secured in a holder before the holder and the object pass a plurality of printheads for printing an ink image on the object. A controller receives the image data and converts it to an object profile. The controller operates ejectors in the printheads with reference to the object profile to attenuate inconsistent ink image density and ink image distortion.

22 Claims, 7 Drawing Sheets

SYSTEM AND METHOD FOR ADJUSTING PRINTHEAD OPERATIONS IN A DIRECT-TO-OBJECT PRINTER HAVING A FIXED PRINTHEAD ARRAY

TECHNICAL FIELD

This disclosure relates generally to a system for printing on three-dimensional (3D) objects, and more particularly, to systems that print on objects with a fixed array of printheads.

BACKGROUND

Commercial article printing typically occurs during the production of the article. For example, ball skins are printed with patterns or logos prior to the ball being completed and inflated. Consequently, a non-production establishment, such as a distribution site or retail store, for example, in a region in which potential product customers support multiple professional or collegiate teams, needs to keep an inventory of products bearing the logos of various teams followed in the area. Ordering the correct number of products for each different logo to maintain the inventory can be problematic.

One way to address these issues in non-production outlets would be to keep unprinted versions of the products, and print the patterns or logos on them at the distribution site or retail store. Printers known as direct-to-object (DTO) printers have been developed for printing individual objects. Operating these printers with known printing techniques, such as two-dimensional (2D) media printing technology, to apply image content onto three-dimensional objects produces mixed results. As long as the surface of the objects are relatively flat, the images are acceptable. However, many products, such as mugs, water bottles, pens, and the like, have curved surfaces, which adversely impact the printed image quality. With known 2D printing processes, the density of the ink image, which can be measured in drops per inch (dpi) or mass per unit area, on the curved product surface varies significantly, often producing streaks in the prints. Moreover, the curvature of the objects cause the ink drops to travel through different distances from the printhead to the object surface. These differences in distances traveled lead to distorted images. Therefore, a printing process control system that produces quality images for a wide variety of products having varying degrees of curvature would be beneficial.

SUMMARY

A new direct-to-object (DTO) printing system is configured with a fixed array of printheads and is able to print the curved surfaces of three-dimensional (3D) objects with quality images. The printing system includes a plurality of printheads, each printhead in the plurality of printheads being configured to eject marking material, a member having a first end and a second end, the plurality of printheads being positioned opposite the member and between the first end and the second end of the member, a holder configured to hold an object and to move along the member between the first end and the second end of the member, an actuator operatively connected to the holder to enable the actuator to move the hold along the member to enable the object to move past the printheads to receive marking material from the printheads in the plurality of printheads, a plurality of imaging devices, the plurality of imaging devices being positioned between the first end of the member and the plurality of printheads, each imaging device in the plurality of imaging device being configured to generate image data of a portion of the object opposite the imaging device as the object passes the plurality of imaging devices, and a controller operatively connected to the plurality of printheads, the actuator, and the plurality of imaging devices. The controller is configured to operate the actuator to move the holder and object along the member, to operate the imaging devices to generate image data of the object in response to the object being opposite the imaging devices, to generate an object profile with reference to the generated image data received from the imaging devices, and to operate ejectors within the printheads of the plurality of printheads with reference to the generated object profile.

A method of operating a DTO printer having a fixed array of printheads enables objects having curved surfaces to be printed. The method includes operating with a controller an actuator operatively connected to a holder to move the holder and an object secured in the holder along a member to which the holder is mounted, operating with the controller a plurality of imaging devices to generate image data of the object in response to the object being opposite the imaging devices, generating with the controller an object profile with reference to the generated image data received from the imaging devices, and operating with the controller ejectors within a plurality of printheads with reference to the generated object profile.

BRIEF DESCRIPTION OF THE DRAWINGS

The foregoing aspects and other features of a printing system that prints the curved surfaces of 3D objects are explained in the following description, taken in connection with the accompanying drawings.

DETAILED DESCRIPTION

Figure 1:
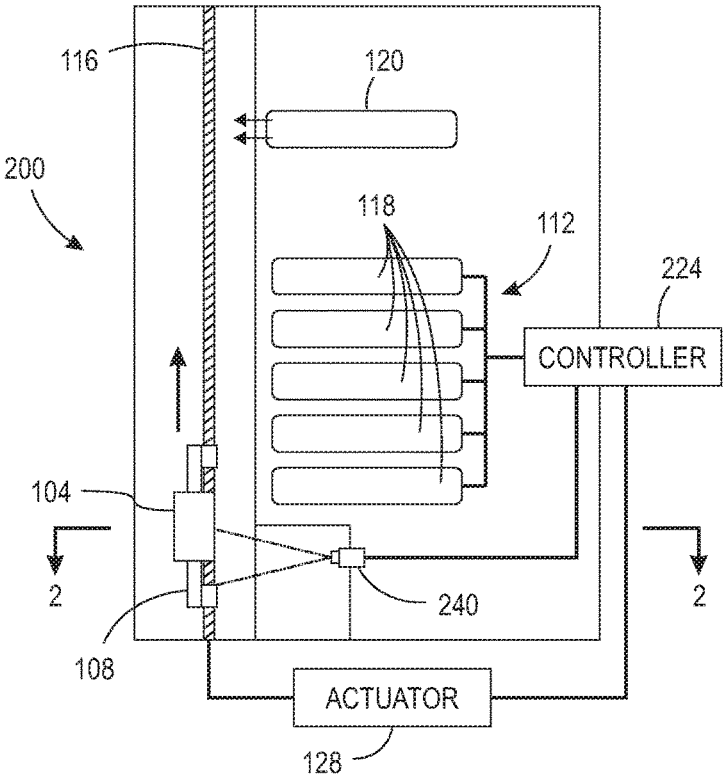
FIG. 1 is a schematic diagram of a side view of a printing system configured to generate a profile of an object on an object holder and adjust the operation of the printheads in the printer.
Figure 2:
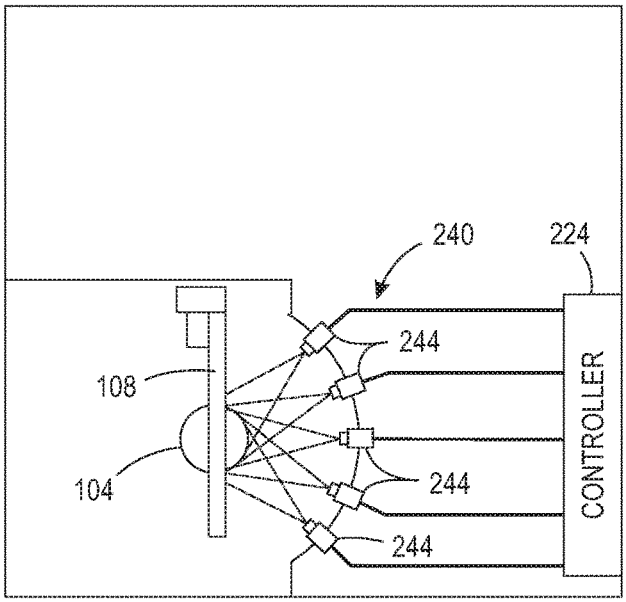
FIG. 2 is a depiction of a camera array shown in FIG. 1 taken along lines 2-2.

For a general understanding of the present embodiments, reference is made to the drawings. In the drawings, like reference numerals have been used throughout to designate like elements.

Figure 6A:
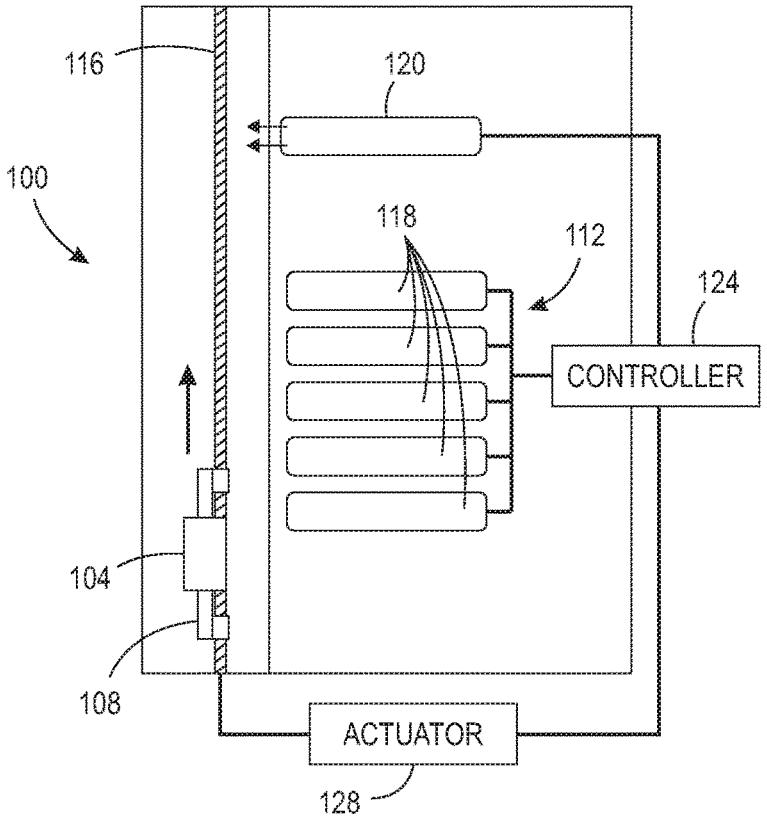
FIG. 6A PRIOR ART
FIG. 6A illustrates an upright prior art printing system that feeds objects on an object holder past an array of fixed printheads.
Figure 6B:
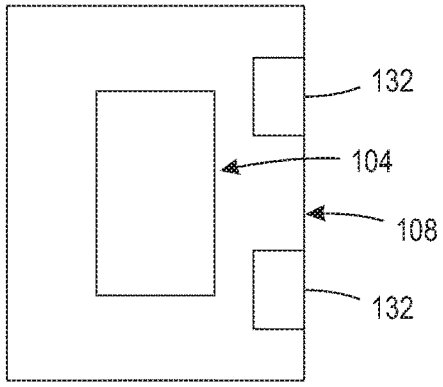
FIG. 6B PRIOR ART
FIG. 6B depicts a frontal view of the object and the object holder in the prior art system of FIG. 6A.

FIG. 6 depicts a prior art printing system 100 configured to print the surface of an object 104 mounted to a holder 108 as the holder 108 moves on a member 116 past an array of fixed printheads 112. As used in this document, the term "fixed printhead" refers to printheads in a printer that have their faceplates remain parallel with the plane of the object holder throughout the printing of the object secured by the bolder. If one or more of the printheads 118 in the array 112 ejects ultraviolet (UV) ink the UV lamp 120 is operated by controller 124 to cure the UV ink. The controller 124 is also configured to operate the actuator 128 to move the holder 108 after the object is mounted into the holder. Controller 124 is configured to operate the printheads in the array 112 to eject marking material onto the surface of the object 104. FIG. 6B depicts the holder 108 and the object 104 as they face the printhead array 112. Latches 132 attach the holder 108 to the member 116.

Figure 7A:
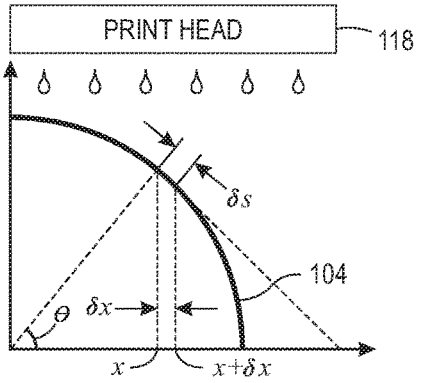
FIG. 7A PRIOR ART
FIG. 7A depicts the issue of increased distance between drops as the curvature increases for an object in the prior art system of FIG. 6A and a graph illustrating this issue in FIG. 7B with an illustration of the resulting streakiness in FIG. 7C.
Figure 7B:
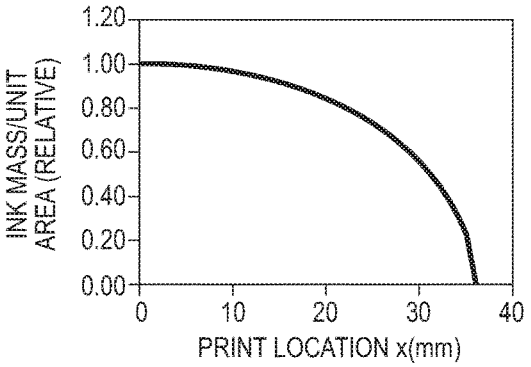
FIG. 7B PRIOR ART
Figure 7C:
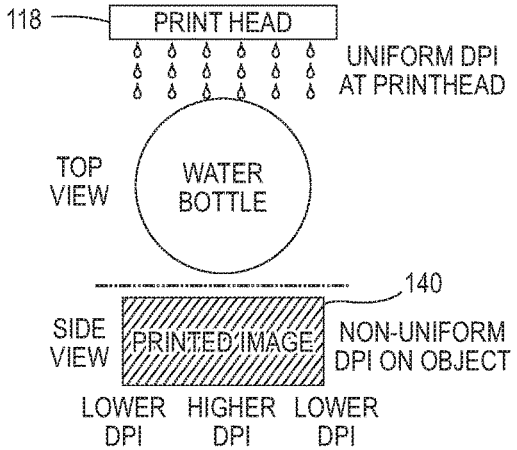
FIG. 7C PRIOR ART

Issues arising from the prior art printer 100 are illustrated in FIG. 7A through 7C and FIG. 8A through 8C. In FIG. 7A, marking material drops are ejected from a printhead 118 towards the surface of the curved object 104. The reader should note that only half of the object is depicted in FIG. 7A, but the other half of the object repeats the relationship in the negative X, positive Y plane. Because the surface of the object curves away from the printhead, the distance between landing areas for drops increases as the object bends further away from the printhead. This relationship is depicted graphically in FIG. 7B and shows that as the location where a drop lands is further from the object position closest to the printhead 118, the ink mass/unit area decreases. As shown in FIG. 7C, the printhead 118 ejects the same number of drops for each position, but because the distance between the drops on the outer periphery increases, the printed image 140 is less dense at the edges than it is at the center.

Figure 8A:
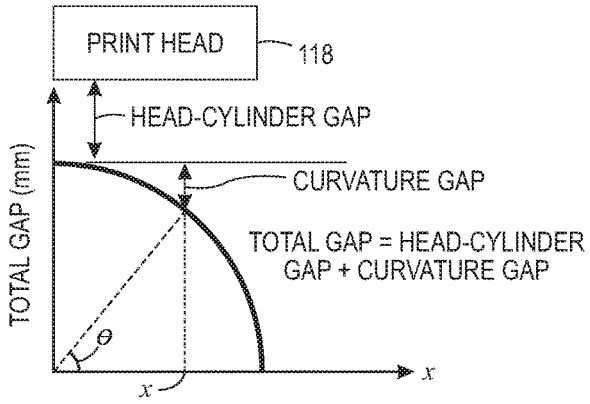
FIG. 8A PRIOR ART
FIG. 8A depicts the issue of increased distance between the printhead and the object as the curvature increases for an object in the prior art system of FIG. 6A and a graph illustrating this issue in FIG. 8B with an illustration of the resulting image distortion in FIG. 8C.
Figure 8B:
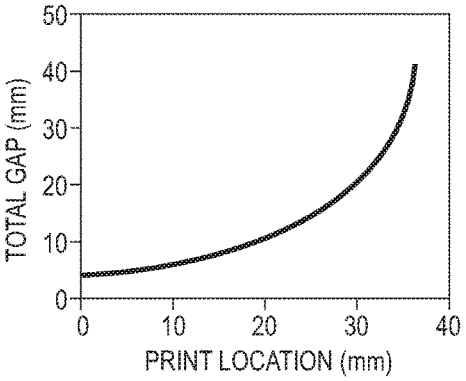
FIG. 8B PRIOR ART

Another problem arising in the prior art printer 100 is shown in FIG. 8A. This figure shows the distance between the printhead and the landing position of drops ejected by the printhead 118 is the sum of the gap between the printhead and the portion of the object closest to the printhead, which is denoted as the head-cylinder gap, and the gap from a tangent at the head-cylinder gap to the position on the curvature of the object, which is denoted the curvature gap. As shown in the figure, the head-cylinder gap remains constant, but the curvature gap increases as the surface of the object falls away from the printhead 118. The graph in FIG. 8B reveals that the distance between the printhead 118 and the landing position for a drop increases as the print location is further removed from the portion of the object closest to the printhead 118. This increase in the distance means a drop at the positions further from the portion of the object closest to the printhead travel further so the object has more time to move on the member 116. Thus, drops ejected at the same time do not form a straight line across the object, but rather formed a curved image 144 as shown in FIG. 7C. This curvature in the image is called image distortion.

To address streakiness and distortion in ink images on curved objects, the printer 200 shown in FIG. 1 has been developed. Printer 200 includes the fixed printheads 118 in the array 112, the UV lamp 120, the member 116, and the holder 108 for objects 104 as previously described. The printer 200 also includes a plurality of imaging devices, which as illustrated is a camera array 240 that is configured to generate image data of an object 104 in holder 108 from a plurality of positions. Although cameras are shown in the figure, the imaging devices can be a plurality of light emitters and light detectors configured to direct light toward the object and receive reflected light so the detectors generate image data as electrical signals corresponding to the light intensity received by the detectors. The imaging devices can also be contact sensors that engage the surface of the object 104 and generate signals corresponding to the degree of deflection of the contact sensors. As used in this document, "imaging device" means any device that is configured to generate one or more signals indicative of a portion of a surface of an object opposite the imaging device. In FIG. 1, each camera in the array is configured to capture color images at a frame rate of 30 frames/second or greater and each frame has a resolution of 1024 pixels by 1024 pixels. The video data is captured in a known format, such as avi or wmv and converted into image data files having a known format, such as PNG, jpeg, or the like. The image data is provided to the controller 224, which is configured with programmed instructions stored in a memory operatively connected to the controller, to process the image data and generate a 3D object profile of the object 104. The 3D object profile generated by the controller is three-dimensional matrix data having (x, y, z) coordinates with reference to the surface of the holder 108 and these profiles are stored in a known format, such as .csv, .txt, or the like. provide this. The controller 224 uses the generated object profile to control operation of the printheads 118 to compensate for streakiness and distortion as described more fully below. In alternative embodiments, rather than generating the object profile from image data of the object produced by the imaging devices, the object profile data can be transmitted to the controller as an equation or a design data file.

Figure 3:
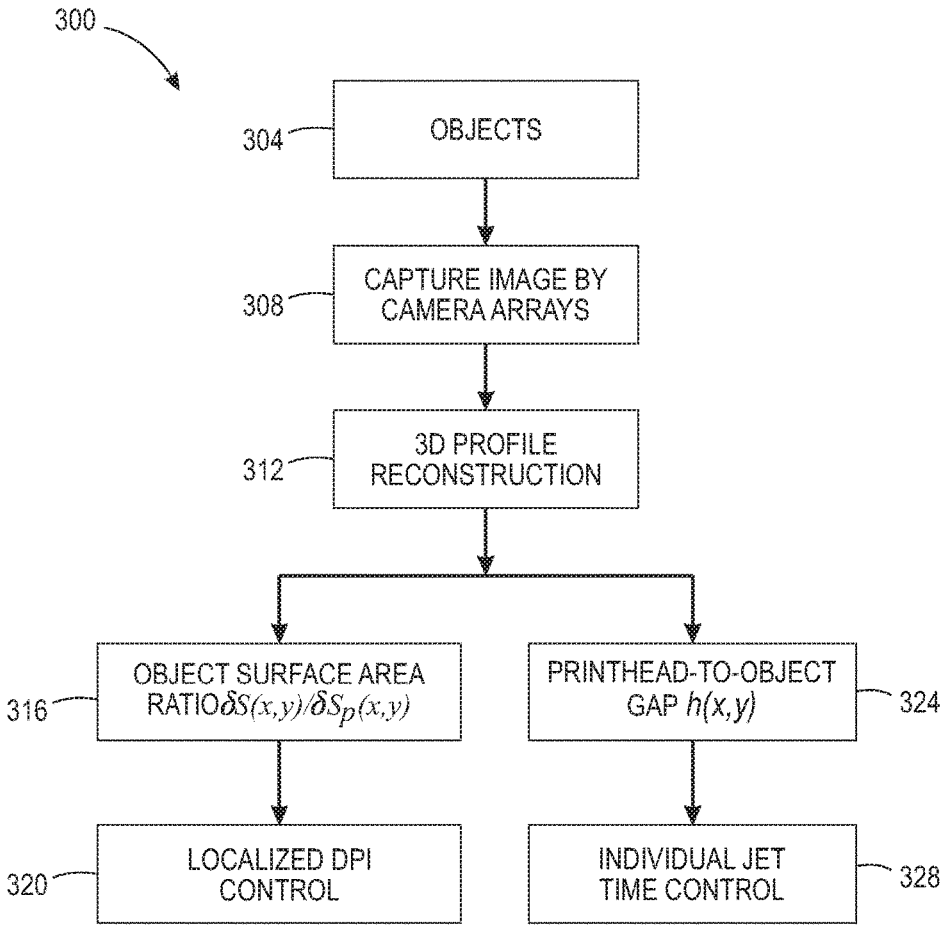
FIG. 3 is a flow diagram of a process for printing objects in the system of FIG. 1.

A process for operating the printer 200 is shown in FIG. 3. In the description of the process, statements that the process is performing some task or function refers to a controller or general purpose processor executing programmed instructions stored in non-transitory computer readable storage media operatively connected to the controller or processor to manipulate data or to operate one or more components in the printer to perform the task or function. The controller 224 noted above can be such a controller or processor. Alternatively, the controller can be implemented with more than one processor and associated circuitry and components, each of which is configured to form one or more tasks or functions described herein. Additionally, the steps of the method may be performed in any feasible chronological order, regardless of the order shown in the figures or the order in which the processing is described.

The process 300 begins with an object 104 being secured within the holder 108 (block 304). The controller operates the actuator 128 that is operatively connected to the holder 108 to move the object and the holder opposite the camera array 240 and the controller operates the cameras in the camera array to generate image data of the object that the controller receives from the camera array as the holder and the object secured in the holder pass the camera array (block 308). If the configuration of the object requires additional time for generation of the image data, the controller is further configured to operate the actuator to maintain the holder and the object opposite the plurality of cameras for a predetermined period of time before continuing movement of the holder and object past the printheads. The controller processes the image data to produce a 3D profile of the object (block 312). The 3D profile is used to identify the object surface area ratio (block 316), which is used by the controller to operate the printheads for localized ink density control (block 320). The 3D profile is also used to identify the printhead-to-object distance (block 324), which is used by the controller to operate the printheads for ejector timing control (block 328).

Figure 4A:
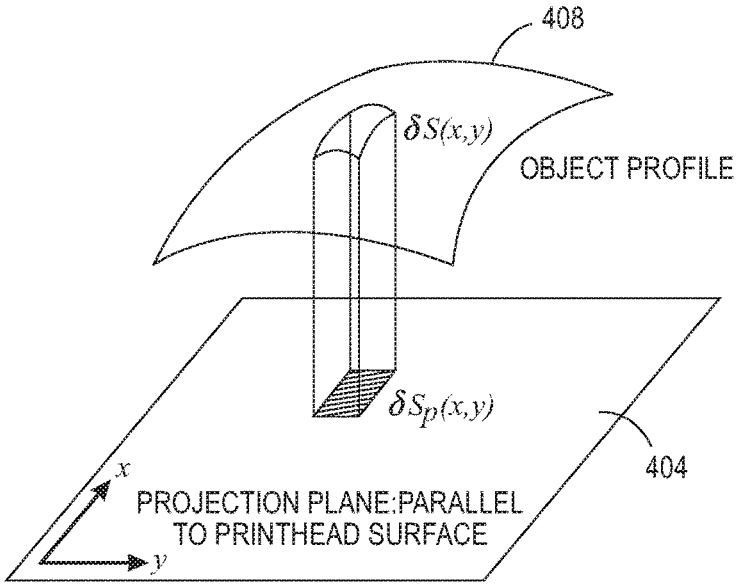
FIG. 4A depicts a projection of a curved portion of an object profile onto a plane.
Figure 4B:
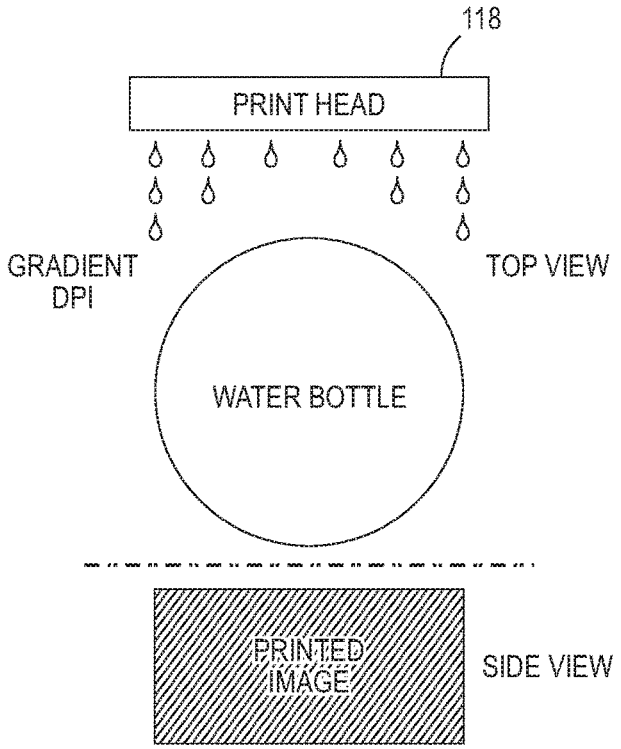
FIG. 4B depicts an adjustment to the printhead operation to compensate for the streaking that occurs at the sides of curved objects and the resulting printed image.

FIG. 4A illustrates the object surface area ratio identification. The projection plane 404 is meshed with the object profile 408 to acquire the local ratio of the object surface area to the corresponding area on the projection plane. This ratio function can be described as $f(x,y)=\delta S(x,y)/\delta_p S(x,y)$. The controller then controls the printhead locally with respect to the area ratio, $dpi_{ph}(x,y)\sim f(x,y)=\delta S(x,y)/\delta_p S(x,y)$, to ensure the mass per unit area on the entire object surface is uniform as shown in FIG. 4B. Specifically, the non-uniform density occurred as shown in FIG. 7C because drops from an ejector opposite a portion of the curved surface further away from the printhead has to cover more area than the same number of drops ejected by an ejector closer to the object. To overcome the effect of this distance difference, the controller 224 increases the ratio of firing pulses to non-firing pulses that operate the ejectors removed from the object surface by its curvature to eject more drops than the ejectors closer to the object. That is, the frequency at which those ejectors are operated is increased. The resulting increased number of drops over the larger area makes the distribution of marking material more uniform with the fewer number of drops in the smaller area closer to the printhead.

Figure 5A:
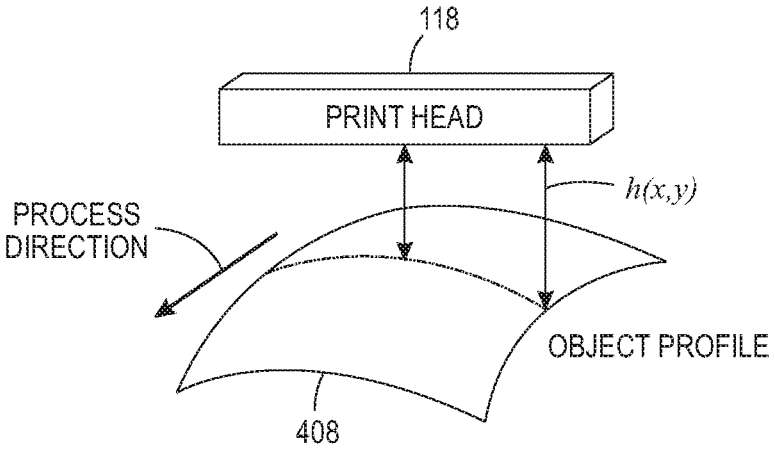
FIG. 5A depicts the printhead to object distance obtained from the object profile.
Figure 5B:
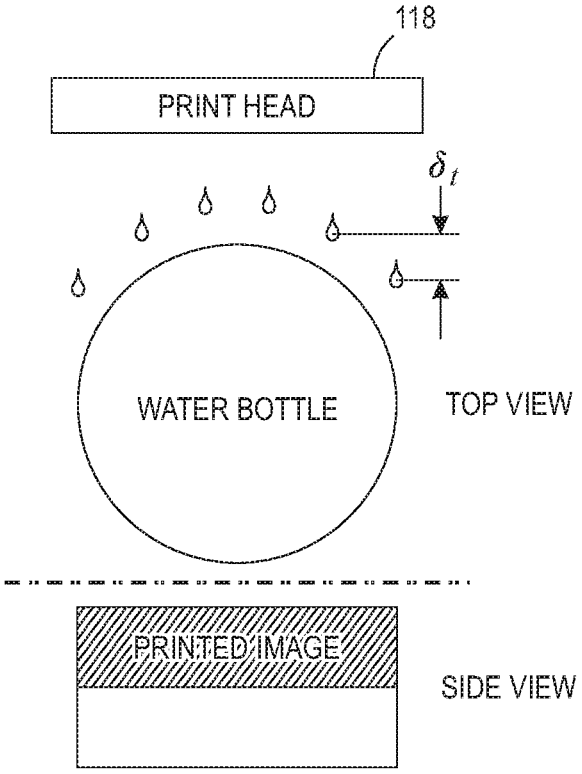
FIG. 5B depicts an adjustment to printhead operation to compensate for the differences in distances between the printhead nozzles and the object and the resulting printed image.
Figure 8C:
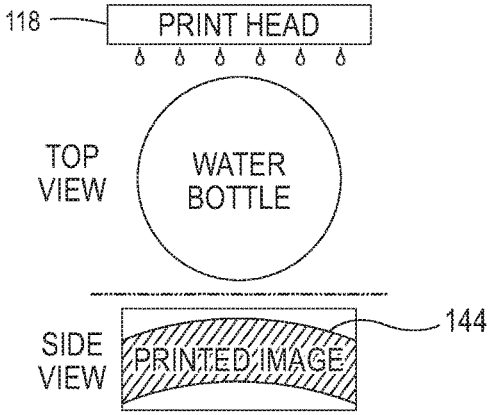
FIG. 8C PRIOR ART

FIG. 5A illustrates the printhead-to-object distance identification. This distance function can be described as h(x,y) and its value is identified with reference to the position of the face of the printhead 118 and the object profile 408 as shown in the figure. This distance is then used to control the timing of the ejector firings. Specifically, drops from the ejectors further from the object travel a longer period of time to reach the surface of the object than drops from ejectors closer to the object because the drops have approximately the same speed. By firing the ejectors further from the object before firing the closer ejectors, the drops from both ejectors arrive at the surface of the object at about the same time. This operation enables the drops to form a straight line as shown in FIG. 5B, rather than the curved line as shown in FIG. 8C.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printing system comprising:

a plurality of printheads, each printhead in the plurality of printheads being configured to eject marking material;

a member having a first end and a second end, the plurality of printheads being positioned opposite the member and between the first end and the second end of the member;

a holder configured to hold an object and to move along the member between the first end and the second end of the member;

an actuator operatively connected to the holder to enable the actuator to move the holder along the member to enable the object to move past the printheads to receive marking material from the printheads in the plurality of printheads;

a plurality of imaging device, the plurality of imaging devices being positioned between the first end of the member and the plurality of printheads, each imaging device in the plurality of imaging devices being configured to generate image data of a portion of the object opposite the imaging device as the object passes the plurality of imaging devices; and a controller operatively connected to the plurality of printheads, the actuator, and the plurality of imaging devices, the controller being configured to operate the actuator to move the holder and the object along the member, to operate the imaging devices to generate image data of the object in response to the object being opposite the plurality of imaging devices, to generate an object profile with reference to the generated image data received from the imaging devices, and to operate ejectors within the printheads of the plurality of printheads with reference to the generated object profile.

2. The printing system of claim 1 wherein the plurality of imaging devices is a plurality of cameras operatively connected to the controller for delivery of the image data generated by each camera in the plurality of cameras to the controller.

3. The printing system of claim 2 wherein the printheads in the plurality of printheads are fixed printheads.

4. The printing system of claim 3, the controller being further configured to operate ejectors that are further from the object than ejectors closer to the object at a first frequency and to operate the ejectors closer to the object at a second frequency, the first frequency being greater than the second frequency.

5. The printing system of claim 4, the controller being further configured to operate ejectors that are further from the object than ejectors closer to the object before operating the ejectors closer to the object to enable drops of marking material from the ejectors further from the object to arrive at the object simultaneously with drops ejected from the ejectors closer to the object.

6. The printing system of claim 3, the controller being further configured to operate ejectors that are further from the object than ejectors closer to the object before operating the ejectors closer to the object to enable drops of marking material from the ejectors further from the object to arrive at the object simultaneously with drops ejected from the ejectors closer to the object.

7. The printing system of claim 6, the controller being further configured to operate ejectors that are further from the object than ejectors closer to the object at a first frequency and to operate the ejectors closer to the object at a second frequency, the first frequency being greater than the second frequency.

8. The printing system of claim 3 further comprising:

an ultraviolet (UV) lamp configured to emit light in an UV range to cure UV curable marking material ejected from the plurality of printheads.

9. The printing system of claim 3 wherein the plurality of cameras are arranged in semi-circular pattern opposite the member.

10. The printing system of claim 3, the controller being further configured to operate the actuator to maintain the holder and the object opposite the plurality of cameras for a predetermined period of time.

11. The printing system of claim 3, the controller being further configured to identify an object surface area ratio with reference to the object profile.

12. The printing system of claim 3, the controller being further configured to identify a printhead-to-object distance with reference to the object profile.

13. A method for operating a printer comprising:

operating with a controller an actuator operatively connected to a holder to move the holder and an object secured in the holder along a member to which the holder is mounted;

operating with the controller a plurality of imaging devices to generate image data of the object in response to the object being opposite the plurality of imaging devices;

generating with the controller an object profile with reference to the generated image data received from the plurality of imaging devices; and operating with the controller ejectors within a plurality of printheads with reference to the generated object profile, the printheads in the plurality of printheads being fixed printheads.

14. The method of claim 13, the operation of the plurality of imaging devices further comprising:

operating a plurality of cameras with the controller to generate the image data.

15. The method of claim 13 further comprising:

operating with the controller ejectors that are further from the object than ejectors closer to the object at a first frequency; and operating the ejectors closer to the object at a second frequency, the first frequency being greater than the second frequency.

16. The method of claim 15 further comprising:

operating with the controller ejectors that are further from the object than ejectors closer to the object before operating the ejectors closer to the object to enable drops of marking material from the ejectors further from the object to arrive at the object simultaneously with drops ejected from the ejectors closer to the object.

17. The method of claim 14 further comprising:

operating with the controller ejectors that are further from the object than ejectors closer to the object before operating the ejectors closer to the object to enable drops of marking material from the ejectors further from the object to arrive at the object simultaneously with drops ejected from the ejectors closer to the object.

18. The method of claim 17 further comprising:

operating with the controller ejectors that are further from the object than ejectors closer to the object at a first frequency and to operate the ejectors closer to the object at a second frequency, the first frequency being greater than the second frequency.

19. The method of claim 14 further comprising:

operating with the controller an ultraviolet (UV) lamp to emit light in an UV range to cure UV curable marking material ejected from the plurality of printheads.

20. The method of claim 14 further comprising:

operating with the controller the actuator to maintain the holder and the object opposite the plurality of cameras for a predetermined period of time.

21. The method of claim 14 further comprising:

identifying with the controller an object surface area ratio with reference to the object profile.

22. The method of claim 14 further comprising:

identifying with the controller a printhead-to-object distance with reference to the object profile.

* * * * *